United States Patent [19]

Zingler et al.

[11] Patent Number: 4,643,058

[45] Date of Patent: Feb. 17, 1987

[54] FLOATING GANG ROTARY SLITTING DEVICE AND METHOD

[75] Inventors: Christian J. Zingler, Succasunna; James D. Bonner, Flemington, both of N.J.

[73] Assignee: Allied Corporation, Morris Township, Morris County, N.J.

[21] Appl. No.: 609,050

[22] Filed: May 10, 1984

[51] Int. Cl.[4] ..... B26D 1/24

[52] U.S. Cl. ..... 83/23; 83/56; 83/78; 83/501; 83/504

[58] Field of Search ..... 83/500–504, 83/429, 430, 664, 491–494, 56, 23, 78

[56] References Cited

U.S. PATENT DOCUMENTS

| | | | |
|---|---|---|---|
| 4,280 | 5/1845 | Bogardus | 83/502 |
| 369,669 | 9/1887 | Vermeulen | 83/501 X |
| 672,899 | 4/1901 | Haasch | 83/502 X |
| 823,797 | 6/1906 | Lupton | 83/501 X |
| 940,862 | 11/1909 | Daniel et al. | 83/501 |
| 1,141,456 | 6/1915 | Kehler | 83/503 X |
| 1,390,612 | 9/1921 | Hickey | 83/429 |
| 1,849,591 | 3/1932 | Rado | 83/500 X |
| 2,659,436 | 11/1953 | Dutro et al. | 83/482 |
| 2,792,889 | 5/1957 | Kussel | 83/501 X |
| 3,359,842 | 12/1967 | Young | 83/664 X |
| 3,621,746 | 11/1971 | Womack | 83/501 X |
| 3,730,043 | 5/1973 | Zimmermann | 83/502 |
| 3,786,706 | 1/1974 | Hyatt et al. | 83/503 X |
| 3,856,513 | 12/1974 | Chen et al. | 75/122 |
| 4,221,257 | 9/1980 | Narasimhan | 164/87 |

FOREIGN PATENT DOCUMENTS

| | | | |
|---|---|---|---|
| 1476128 | 2/1967 | France . | |
| 2224256 | 10/1974 | France . | |
| 2252006 | 6/1975 | France . | |
| 2289303 | 5/1976 | France . | |
| 9086 | of 1911 | United Kingdom | 83/500 |
| 1101220 | 1/1968 | United Kingdom . | |

OTHER PUBLICATIONS

796 Sheet Metal Industries, vol. 56, No. 5 (1979), J. F. Madachy, "Helper Drive Slitting".

Technica AB brochure, "Precision Strip Slitting Machine T 1700", 1982–1983.

Arrow Converting Equipment, Inc., Technical Data Sheet, "Shear Knives".

D. Reilly, "Rotary Slitting of Sheet and Strip", Sheet Metal Industries, Mar. 1971, pp. 213–226.

T. J. Hadlington, "Design of Slitting Lines and the Importance of Accuracy in the Product", Sheet Metal Industries, May 1980, pp. 482–490.

R. L. Zimmer, "Production Coil Slitting", Carbide and Tool Journal, Nov.–Dec. 1982, pp. 20–22.

*Primary Examiner*—James M. Meister

*Attorney, Agent, or Firm*—Paul Yee; James Riesenfeld

[57] ABSTRACT

The present invention provides a method and apparatus for slitting sheet material. The apparatus includes a first arbor shaft for mounting and rotatably driving a first rotary cutter. The first cutter is comprised of at least one rotary knife element having two opposite side faces, and the first arbor shaft is constructed to allow axially movement of the knife element along the first arbor shaft. A second arbor shaft mounts and rotatably drives a second rotary cutter. The second rotary cutter is comprised of at least one rotary knife element which has two opposite side faces and is movable axially along the second arbor shaft. The second arbor shaft is also selectively movable radially with respect to the first arbor shaft to provide a selected intermeshing overlap region between the first cutter knife element and the second cutter knife element. A resilient force means resiliently urges the first cutter knife element axially along the first arbor shaft to contact the second cutter knife, thereby providing a selected contact pressure and a substantially zero clearance between each pair of intermeshing faces of the first and second cutter knife elements at the overlap region. Drive means selectively rotate the first and second arbor shafts.

15 Claims, 9 Drawing Figures

FLOATING GANG ROTARY SLITTING DEVICE AND METHOD

BACKGROUND OF THE INVENTION

1. Field of the Invention

The invention relates to the slitting of sheet material. More particularly, the invention relates to the slitting of sheet metal, such as amorphous metal sheet.

2. Brief Description of the Prior Art

Conventional rotary slitting devices, such as those manufactured by Technical AG, Grenchen, Switzerland, have employed rotary knives mounted on arbor shafts and separated by discrete spacer rings.

Other conventional rotary slitting devices employ thin, flexible rotary knives rigidly located at regularly spaced positions along a top and a bottom arbor shaft. The arbor shafts are parallel, and the top and bottom knives overlap in alternating, intermeshing fashion. The arbor shafts are also slightly offset sideways in the axial direction to bring the intermeshing top and bottom knife faces into contact with one another. The contacting knives deflect slightly and the resulting spring action holds the knives in close contact during use.

Another type of slitting device employs a gang of regularly spaced rotary knives held at fixed axial positions along a shaft. The knives engage a rotary anvil which has the general configuration of a circumferentially grooved cylinder. The flexible knives are positioned within the grooves and offset sideways to bring a side of each knife into contact with a side of its corresponding groove. The knife deflects slightly to provide a spring action that maintains contact between the knife and the side of the groove during operation.

Still another type of slitting device, such as manufactured by Arrow Converting Equipment, Inc. located in Fairfield, N.J., employs a thin, rotary, male knife blade which engages an annular groove formed into one axial face of a female knife element. A relatively bulky knife holder portion carries the male blade, and an annular knife key "garter" spring urges the blade axially against an annular retaining ring. However, when employed to slit thin metal, this type of device produces undesired width variations and folds and tears on the slit edges.

Conventional slitting devices, such as those discussed above, have been expensive or have not been satisfactory for slitting thin metal sheet, such as amorphous, glassy metal strips. When slitting metal, the devices have employed expensive, precisely machined spacers placed between individual knife elements to maintain precise clearances between the knives. These clearances must be precisely maintained to produce consistent evenly slit edges. If the gap clearance between intermeshing is too small or too large, the slit edges are uneven, bent or have undesired burrs. Machine setup time is long and costly because these clearances must be precisely measured and established. In addition, normal operation rapidly degrades the clearances. For example, thermal expansion can undesirably increase or decrease the clearance gap between the cutter knives.

Slitting devices with flexible, intermeshing knives that actually contact one another have been suitable only for slitting soft sheet material, such as plastic or mylar. The flexible knife slitting devices are expensive to manufacture and expensive to maintain because the individual knife elements must be very precisely aligned along their respective arbor shafts. If a knife element is mispositioned, it will not contact its corresponding, adjacent knife element mounted on the opposite arbor with the correct amount of side force, and the slitting operation will be degraded.

Thus, conventional slitting devices for thin sheet metal have been expensive, difficult to set up and have required precision machined components.

SUMMARY OF THE INVENTION

The present invention provides an accurate and versatile method and apparatus for slitting sheet material which minimizes the need for precision components. Generally stated, the apparatus of the invention includes a first arbor shaft for rotatably mounting a first rotary cutter. This first cutter is comprised of at least one rotary knife element having two opposite side faces, and the first arbor shaft is constructed to allow axial movement of the knife element along the shaft. A second arbor shaft rotatably mounts a second rotary cutter. The second cutter is comprised of at least one rotary knife element which has two opposite side faces and is movable axially along the second arbor shaft. The second shaft is also selectively movable radially with respect to the first arbor shaft to provide a selected, intermeshing overlap region between the first cutter knife element and the second cutter knife element. A resilient force means resiliently urges the first cutter knife element axially along the first arbor shaft to contact the second cutter knife, thereby providing a substantially zero clearance between each pair of intermeshing faces of the first and second cutter knife elements at the overlap region. A drive means selectively rotates the first and second arbor shafts.

The invention minimizes the need for extra precision spacers between the knife elements, and provides a self-setting, side-to-side knife engagement with approximately zero clearance. The invention also minimizes the need for high precision knife-width control and is self-compensating for thermal expansion of the knives since the knife elements are not rigidly held at fixed locations along the axial length of their respective arbor shafts. Incremental changes in the slitting width can be accomplished by changing the engagement order of the individual knife elements, and there may be a self-sharpening action, produced by the substantially zero knife clearance, which can reduce maintenance and operating costs.

BRIEF DESCRIPTION OF THE DRAWINGS

The invention will be more fully understood and further advantages will become apparent when reference is made to the following detailed description and accompanying drawings in which.

DESCRIPTION OF PREFERRED EMBODIMENTS

Figure 1:
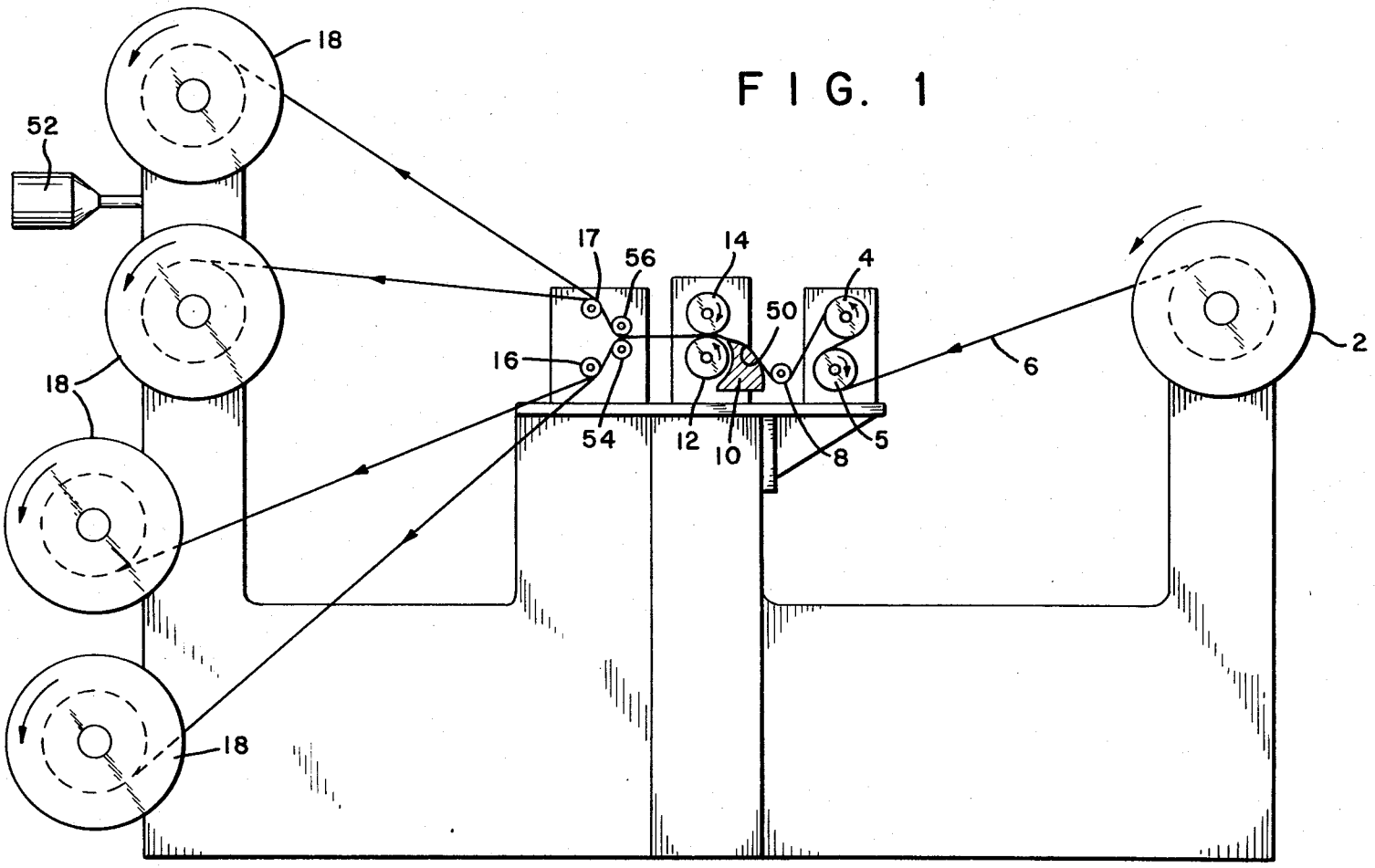
FIG. 1 shows a schematic representation of the slitting apparatus of the invention.

FIG. 1 shows a schematic representation of the apparatus of the invention. As strip or sheet material 6 comes off supply reel 2, feed means deliver the sheet into the nip region between two counter-rotating cutters 12 and 14. The feed means includes a set of S-wrap rollers 4 and 5, guide roller 8, and an optional, curved restraining surface 50. The sheet passes along an S-path defined by rollers 4 and 5, and a suitable torque brake associated with supply reel 2 maintains a selected tension on sheet 6. The S-wrap rollers 4 and 5 pull the sheet from the supply reel and establish the desired input speed of the sheet into the cutters. Guide roller 8 guides the sheet onto the optional, curved, "camel back" restraining surface 50, which is supported by a base 10. Surface 50 imparts a curved configuration to sheet 6 which minimizes wrinkling and warping of the sheet as it enters the nip region between a bottom (first) rotary cutter 12 and a top (second) rotary cutter 14. After cutters 12 and 14 have slit the sheet, a take up means receives the slit material. The shown take up means includes separator rolls 16 and 17 and take up reels 18. Suitable take up drive means, such as motor 52, rotate reels 18 by means of suitable slip clutches to allow the individual reels to match the individual speeds of the corresponding strips of advancing material, and to provide a selected winding tension on the slit material.

While the invention is generally described as having a top and bottom arbor shaft, it is readily apparent that various other configurations, such as side-by-side arbor shafts, would be equivalent, provided the two shafts are arranged generally parallel to each other.

The apparatus of the invention is particularly useful for slitting thin sheet, such as glassy metal sheet. However, it is readily apparent that the apparatus can also be employed to slit other types of thin sheet material measuring 15 mils (0.38 mm) or less in thickness.

Amorphous, glassy metal is prepared by cooling a melt of the desired composition at a rate of at least about $10^{5}$° C. per second, employing metal alloy quenching techniques well known to the glassy metal alloy art; see, e.g., U.S. Pat. No. 3,856,513 to Chen, et al. Glassy metal sheet can be produced in accordance with the method and apparatus described in U.S. Pat. No. 4,221,257 to Narisimhan.

Sufficiently rapid quenching conditions produce a metastable, homogeneous, ductile material. The metastable material may be glassy, in which case there is no long range order. X-ray diffraction patterns of glassy metal alloys show only a diffuse halo, similar to that observed for inorganic oxide glasses. Such glassy alloys must be at least 50% glassy to be sufficiently ductile to permit subsequent handling, such as stamping complex shapes from ribbons of the alloy. Preferably, the glassy metal should be at least 80% glassy to attain superior ductility. The metastable phase may also be a solid solution to the constituent elements. These metastable, solid solution phases are not ordinarily produced under conventional processing techniques employed in the art of fabricating crystalline alloys. X-ray diffraction patterns of the solid solution alloys show the sharp diffraction peak characteristic of crystalline alloys, with some broadening of the peaks due to the fine grained size of crystallites. The metastable materials are also ductile when produced under the appropriate quenching conditions.

Sheets or strips of glassy metal are typically less than 10 mils (0.254 mm) in thickness. In addition, the strips can be 6 inches (15 cm) or more in width.

Figures 2, 2A:
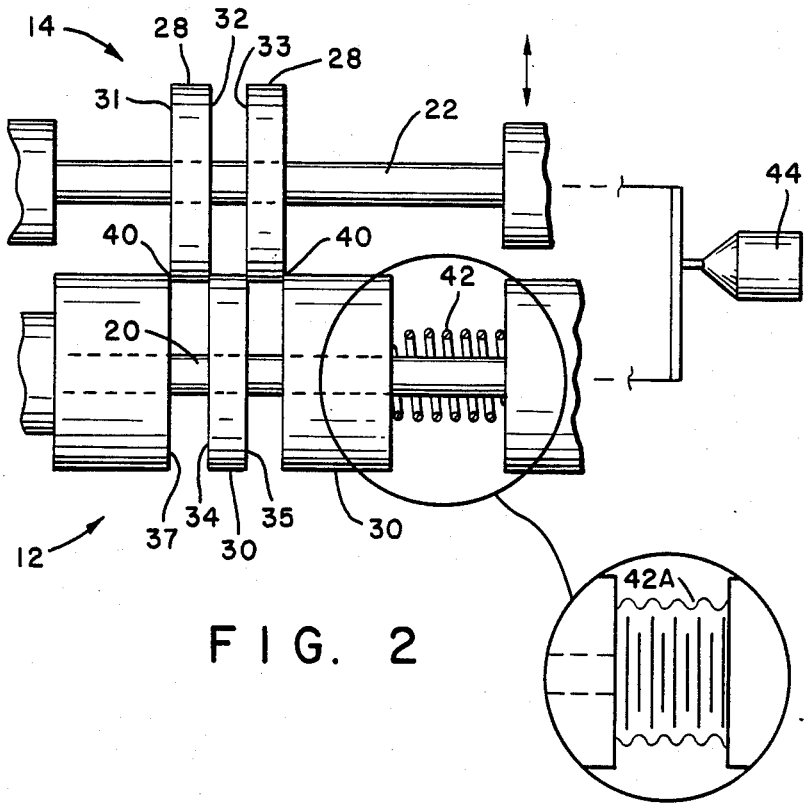
FIG. 2 shows intermeshed top and bottom cutter knife elements of the apparatus of the invention.
FIG. 2A shows an alternative to the resilient force means shown in FIG. 2

FIG. 2 shows a more detailed view of the intermeshing cutters of the apparatus of the invention. A first (bottom) arbor shaft 20 supports and rotatably mounts a first (bottom) rotary cutter 12. Cutter 12 is comprised of at least one, but preferably a plurality of rotary knife elements 30 having two opposite side faces 34. The knife elements are rigid and substantially inflexible, and shaft 20 is constructed to allow substantially free axial movement of knife elements 30 therealong.

A second (top) arbor shaft 22 supports and rotatably mounts a second (top) rotary cutter 14. Cutter 14 is comprised of at least one, but preferably a plurality of rotary knife elements 28 having opposite side faces 32. Knife elements 28 are rigid (substantially inflexible) and movable axially along arbor shaft 22. In addition, top shaft 22 is selectively movable in the radial direction with respect to bottom shaft 20 to provide a selected, intermeshing overlap region 40 between bottom cutter knives 30 and top cutter knives 28.

Resilient force means, such as spring 42 (or alternatively, a pneumatic actuator (shown as 42A in FIG. 2A) or even a gravity/weight arrangement), resiliently urges bottom knife elements 30 axially along bottom arbor shaft 20 to contact top knife elements 28 at overlap regions 40. As a result, spring 42 establishes a selected contact pressure and a substantially zero clearance between each pair of intermeshing faces; e.g. 31–37, 32–34 and 33–35; of the bottom knives 30 and top knives 28. In the shown embodiment, spring 42 is a helical coil spring concentrically located about shaft 20 compressed to provide about 1 to 20 lbs force (4.4–90N) against knife elements 30. Preferably, the spring provides about 5 lb force (22.2N).

There are two main factors that affect the proper selection of the magnitude of the resilient force. The force should be (a) large enough to maintain the extremely close positioning (substantially zero clearance) between to intermeshed knife elements during the actual slitting operation, but (b) not so great that it causes excessive friction and wear on the knives.

It is readily apparent that the described configuration can be modified in various ways to provide an equivalent result. For example, spring 42 may be optionally located about the top arbor shaft 22 to contact and urge against top knife element 28. Additionally, various spring (resilient force) configurations, located on either or both arbor shafts, can be employed with equivalent effect.

In the shown embodiment, a suitable drive means, such as motor 44, operating through conventional gear box or drive belt mechanisms selectively rotates one or both of arbor shafts 20 and 22. Where bottom knives 30 and top knives 28 are substantially the same diameter, shafts 20 and 22 are driven at the same rotational speed. To obtain good slitting operation, the peripheral speeds of the top and bottom rotary knife elements should be approximately equal, and not less than the speed of the advancing sheet being fed into the gap between cutters 12 and 14.

In a preferred embodiment, the peripheral speed of the rotating knives is about 2% greater than the input feed speed of sheet 6, with the input speed ranging from about 1–500 ft/min. Rotary knives 28 and 30 are about 3 inch (7.6 cm) diameter cylinders with an axial width of about $\frac{1}{8}$ in. (about 0.32 cm), and are composed of a tool steel, such as M2 or M4 tool steel.

It is readily apparent, however, that the width of the knife can be modified as needed to produce any desired width of slit material. It is also readily apparent that the knife elements may be constructed from various other types of suitable tool material.

Figure 3A:
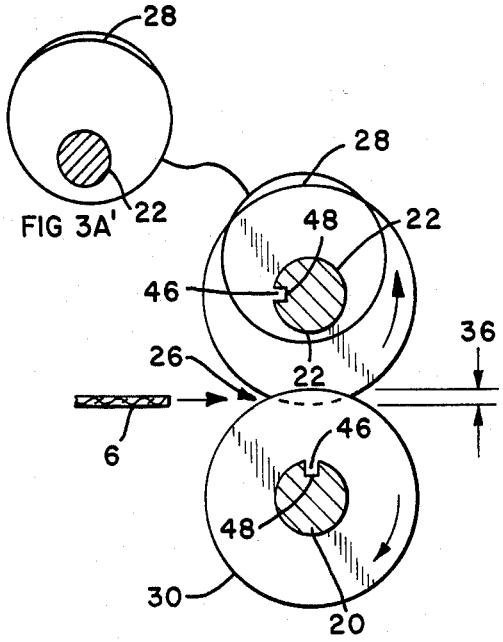
FIGS. 3A and 3*a*′ show a side elevational view of two intermeshed cutter knives.
Figure 3B:
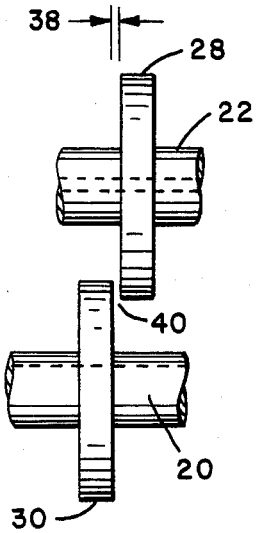
FIG. 3B shows a front elevational view of two intermeshed cutter knives.

As representatively shown in FIG. 3A and FIG. 3B, knives 28 and 30 can be constructed to be rotatably driven by the respective arbor shafts 22 and 20. For example, knives 28 and 30 can have central, radially extending keys 46 constructed to engage keyways 48 formed into shafts 22 and 20. This configuration allows the knives to move freely along the axial direction of the arbor shafts while providing a positive drive mechanism between the shaft and knife elements. The operable overlap distance 36 depends upon the material being slit, and for slitting glassy metal strip the overlap distance ranges from about 0.002–0.007 inches (about 0.058–0.178 mm).

As previously discussed, the clearance distance 38 between intermeshing knives at overlap region 40 is substantially equal to zero. Additionally, knives 28 and 30 counter-rotate to draw sheet 6 into nip region 26 therebetween as the strip is being sheared and cut. Other traction devices, such as additional traction rollers 54 and 56, may also be used to frictionally engage strip 6 to draw it through the cutter knives.

The apparatus of the invention can have various optional configurations. For example, the top and bottom knife elements may have different diameters, or the top and bottom cutters may be driven at different rotational speeds. Driving the top and bottom cutters at different speeds minimizes the situation where a particular portion of the top cutter continually engages the same portion of the bottom cutter during every revolution of the cutters.

In another configuration, shown in FIG. 3*a*′, the knife elements of one or both of the rotary cutters may be allowed to free-wheel about their respective arbor shafts. Traction means would draw the sheet material through the nip of the cutters, and a frictional engagement between the sheet and the knife elements would provide the drive means that counter rotates the intermeshed knife elements.

To set up the knife cutters for proper operation, spring 42 is held compressed to permit a substantially unrestricted location and arrangement of knife elements 30 along arbor 20. Arbor 22 is moved down until the outer peripheral surfaces of knife elements 28 scuff or are within about 0.002 inches (0.005 cm) of the outer peripheral surfaces of knife elements 30. This initial clearance can be measured by conventional means, such as a feeler gauge. Knife elements 28 are selectively located and arranged to intermesh with knife elements 30, and arbor 22 is moved until there is a desired amount of overlap between intermeshing knife elements and 30. Spring 42 is then released to contact adjacent knife element 30 and move it axially along arbor shaft 20. The other knife elements, in turn, move together along the respective arbor shafts 20 and 22 and touch at overlap regions 40 to provide a selected contact pressure and an essentially zero clearance between the intermeshing faces of adjacent knife elements 28 and 30.

During the actual slitting operation, the knife elements are able to move axially against the resilient force and along their respective arbor shafts to compensate for thermal expansion in the cutters. The ability of the knife elements to move axially also minimizes the development of undesireable, excessive contact pressures between the intermeshed knives, which could rapidly wear or destroy the knives.

Figure 4:
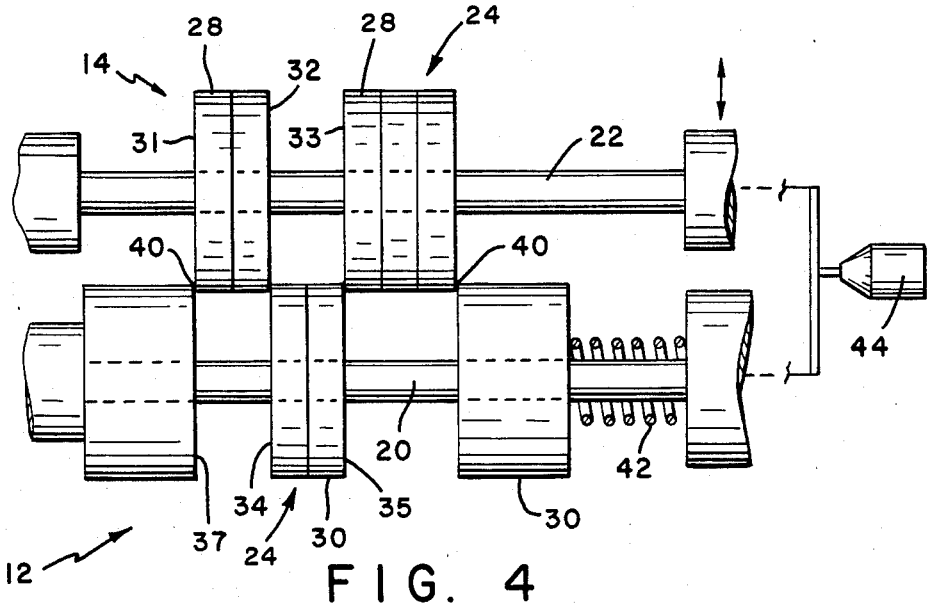
FIG. 4 shows intermeshed, composite top and bottom cutter knives composed of multiple, juxtaposed knife elements.

FIG. 4 representatively shows how the slitting device of the invention can be adjusted to provide incremental changes in slitting width. Individual knife elements 28 or 30 can be juxtaposed together, side by side, to form a composite knife element 24 composed of a plurality of knife elements 28 or 30. Alternatively a selected spacer or plurality of spacers can be juxtaposed between a pair of knife elements to produce the composite knife element. The two knife elements at the opposite ends of the axially extending, stacked composite knife provide the operative cutting edges. Each composite knife element 24 is employed in the manner previously described for the individual knife elements 28 or 30.

The following examples are presented to provide a more complete understanding of the invention. These specific techniques, conditions, materials, proportions and reported data set forth to illustrate the principles and practice of the invention are exemplary and should not be construed as limiting the scope of the invention.

EXAMPLE

Figure 5A:
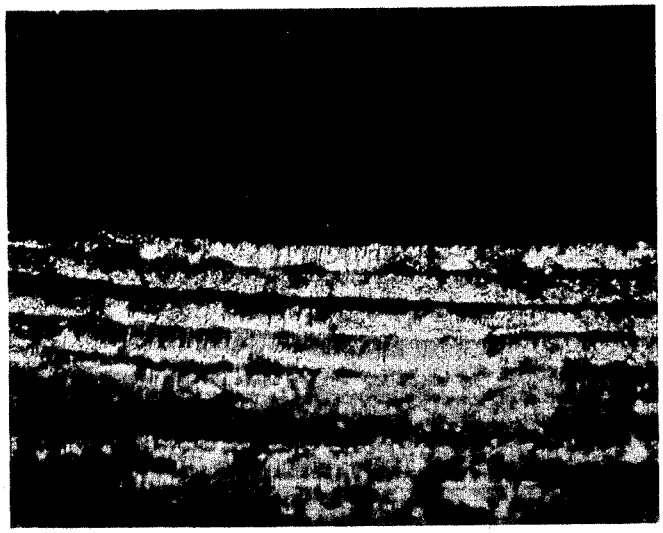
FIG. 5A shows material slit on a conventional slitting device.

A cross-section taken through the thickness of a glassy metal sheet slit in a conventional slitting device manufactured by Ruesch located in Springfield, N.J. is shown in FIG. 5A. The shear regions along the slit edge are light colored and extend in horizontal bands. The tear regions are darker colored bands located between the lighter shear regions. As representatively shown in FIG. 5A, a conventional slitting device produces a slit edge having tear regions that are undesirably rough, uneven, and grainy in appearance.

Figure 5B:
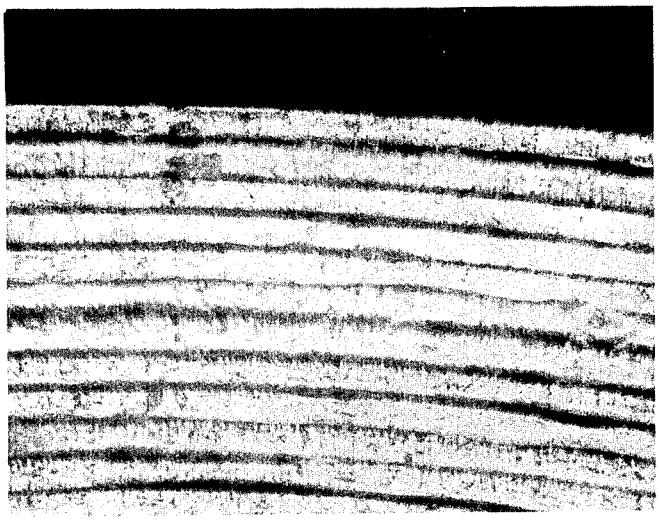
FIG. 5B shows material slit on the slitting apparatus of the invention.

A cross-section taken through the thickness of a glassy metal sheet slit in the slitting device of the invention is representatively shown in FIG. 5B. The material slit on the device of the invention has smoother, more evenly cut edges; the tear regions are thinner, more even, and significantly less rough and grainy. In addition, the width variation of the slit material has been held to plus or minus 2.0 mils (0.051 cm) and can be held to about 0.2–0.3 mils (0.0051–0.0076 cm), depending on the machined accuracy of the cutter knives.

Having thus described the invention in rather full detail, it will be understood that such details need not be strictly adhered to but that various changes and modifications may suggest themselves to one skilled in the art, all falling within the scope of the invention as defined by the subjoined claims.

We claim:

1. A slitting apparatus for slitting sheet material, comprising:

a. a first free-wheeling arbor shaft for rotatably mounting a first rotary cutter, said first cutter comprised of at least one rotary knife element having two opposite side faces, and said first arbor shaft constructed to allow axial movement of said knife element along said first arbor shaft;

b. a second free-wheeling arbor shaft for rotatably mounting a second rotary cutter, said second cutter comprised of at least one rotary knife element which has two opposite side faces and is movable axially along said second arbor shaft, and said second arbor shaft being selectively moveable radially with respect to said first arbor shaft to provide a selected, intermeshing overlap region between said first cutter knife element and said second cutter knife element;

c. resilient force means for resiliently urging said first cutter knife element axially along said first arbor shaft to contact said second cutter knife element, thereby providing a substantially zero clearance between each pair of intermeshing faces of said first and second cutter knife elements at said overlap region; and d. drive means for selectively rotating said first and second shafts.

2. An apparatus as recited in claim 1, further comprising:

a. feed means for delivering said sheet material into a nip region between said first and second cutters at a selected input speed, and b. take-up means for receiving slit material.

3. An apparatus as recited in claim 2, wherein said drive means is constructed to provide a rotational speed at the periphery of said cutter knife elements which is not less than the input speed of the sheet material.

4. An apparatus as recited in claim 1, wherein said resilient force means is comprised of a spring.

5. An apparatus as recited in claim 1, wherein said resilient force means is comprised of a pneumatic actuator.

6. An apparatus as recited in claim 1, wherein at least one of said knife elements is comprised of a composite knife element.

7. An apparatus as recited in claim 1, wherein at least one of said first and second rotary cutters is comprised of a plurality of rotary knife elements.

8. An apparatus as recited in claim 7, wherein at least one of said knife elements is comprised of a composite knife element.

9. An apparatus as recited in claim 1, wherein each of said rotary knife elements is substantially rigid.

10. An apparatus as recited in claim 1, wherein said resilient force means also provides a selected contact pressure between each pair of intermeshing faces of said first and second cutter knife elements at said overlap region.

11. A method for slitting sheet material, comprising the steps of:

a. providing a first free-wheeling rotary cutter, on a first arbor shaft, said first cutter comprised of at leat one rotary knife element having two opposite side faces, and said first arbor shaft constructed to allow axial movement of said knife element along said first arbor shaft;

b. providing a second free-wheeling rotary cutter, on a second arbor shaft, said second cutter comprised of at least one rotary knife element which has two opposite side faces and is moveable axially along said second arbor shaft;

c. selectively moving said second arbor shaft radially with respect to said first arbor shaft to provide a selected, intermeshing overlap region between said first cutter knife element and said second cutter knife element;

d. rotatively driving at least said first arbor shaft; and e. resiliently urging said first cutter knife element axially along said first arbor shaft to contact said second cutter knife element, thereby providing a substantially zero clearance between each pair of intermeshing faces of said first and second cutter knife elements at said overlap region.

12. A method as recited in claim 11, further comprising the steps of:

a. delivering said sheet material into a nip region between said first and second cutters at a selected input speed; and b. taking up slit material.

13. A method as recited in claim 12, further comprising the step of providing a rotational speed at the periphery of said cutter knife elements which is not less than the input speed of the sheet material.

14. A method as recited in claim 11, wherein at least one of said first and second rotary cutters is comprised of a plurality of rotary knife elements.

15. A method as recited in claim 11, further comprising the step of providing a selected contact pressure between each pair of intermeshing faces of said first and second cutter knife elements at said overlap region.

* * * * *

UNITED STATES PATENT AND TRADEMARK OFFICE

CERTIFICATE OF CORRECTION

PATENT NO. : 4,643,058

DATED : February 17, 1987

INVENTOR(S) : C.J. Zingler et al.

It is certified that error appears in the above-identified patent and that said Letters Patent is hereby corrected as shown below:

Col. 6, lines 56 & 57: "a. a first free-wheeling arbor shaft for rotatably mounting a first rotary cutter, said first cutter com-" should read -- a. a first arbor shaft for rotatably mounting a first free-wheeling rotary cutter, said first cutter com- --.

Col. 6, lines 62 & 63: "b. a second free-wheeling arbor shaft for rotatably mounting a second rotary cutter, said second cutter" should read -- b. a second arbor shaft for rotatably mounting a second free-wheeling rotary cutter, said second cutter --.

Col. 7, line 17: After "speed", "comma" should be replaced by a semi-colon.

Signed and Sealed this

First Day of December, 1987

*Attest:*

DONALD J. QUIGG

*Attesting Officer*

*Commissioner of Patents and Trademarks*